United States Patent [19]

Rudy, Jr. et al.

[11] Patent Number: 4,778,411

[45] Date of Patent: Oct. 18, 1988

[54] RETENTION SYSTEM FOR CONNECTOR KEY MEMBER

[75] Inventors: William J. Rudy, Jr., Annville; Howard R. Shaffer, Millersburg; Daniel E. Stahl, Dauphin, all of Pa.

[73] Assignee: AMP Incorporated, Harrisburg, Pa.

[21] Appl. No.: 42,495

[22] Filed: Apr. 24, 1987

[51] Int. Cl.[4] ..... H01R 13/64

[52] U.S. Cl. ..... 439/681; 439/358

[58] Field of Search ..... 439/677–681, 439/350–353, 357, 358, 633, 717, 732

[56] References Cited

U.S. PATENT DOCUMENTS

| | | | |
|---|---|---|---|
| 3,491,330 | 1/1970 | Barnhart et al. | 339/184 |
| 3,611,272 | 10/1971 | Fairbairn et al. | 339/184 M |
| 3,714,617 | 1/1973 | Bright et al. | 439/681 |
| 3,944,316 | 3/1976 | Newman et al. | 339/111 |
| 4,159,862 | 7/1979 | Funck et al. | 439/681 |
| 4,277,126 | 7/1981 | Lincoln | 339/186 M |
| 4,415,214 | 11/1983 | Obst | 439/681 |
| 4,448,467 | 5/1984 | Weidler | 339/17 LC |
| 4,519,667 | 5/1985 | Canning et al. | 439/681 |
| 4,568,134 | 2/1986 | DiMondi | 439/680 |

FOREIGN PATENT DOCUMENTS

| | | | |
|---|---|---|---|
| 0792386 | 12/1980 | U.S.S.R. | 439/681 |

OTHER PUBLICATIONS

Weber et al., U.S. patent application Ser. No. 06/907,703 filed Sep. 15, 1986.

*Primary Examiner*—David Pirlot

*Attorney, Agent, or Firm*—Anton P. Ness

[57] ABSTRACT

A key member (50) for an electrical connector (10,100) is removably securable in the housing (12,110) thereof without fasteners and has a rearward retention section (56) comprised of preferably four radially inwardly deflectable quadrants (70) which ride over retention projections (42,130) within connector passageways (28,114). The retention projections (42,130) seat in a recess (82,86) of the key member retention section (56) to secure the key member (50) in the passageway (28,114) against axial movement or misalignment while another polygonal shaped passageway section (36,122) secures a polygonal shaped section (52) of the key member (50) against rotation. The retention projections (42,130) are preferably annular or semiannular to seat in an annular recess (82,86). In one embodiment the key member (50) can be retained in the passageway (114) by a transverse plate-like member (142) inserted into a transverse slot (128) in the connector housing (110) which has fingers (146) passing by the key member (50) on opposing sides in an annular recess (82) and secure therearound to prevent axial movement, and the key member (50) in return can secure to the housing (10) the plate-like member (142) which may be a section of a spring latch (140) to latch the connector (100) to a mating connector (10).

20 Claims, 8 Drawing Sheets

RETENTION SYSTEM FOR CONNECTOR KEY MEMBER

FIELD OF THE INVENTION

This invention relates to the field of electrical connectors, more particularly to keying systems therefor.

BACKGROUND OF THE INVENTION

When a plurality of like first connectors and like second connectors matable therewith are used in the same vicinity, it is important to provide means to permit mating of particular pairs intended to be mated to each other, while preventing mating of pairs not intended to be mated to each other. This may be accomplished by use of visual coding such as indicia, but is much preferred to be accomplished by keying mechanisms which physically prevent mating of connectors not intended to be mated to each other while allowing desired mating of appropriate pairs. In one manner of keying, key members are known which are secured in one of the first and second connectors which cooperate with opposing key members of the other. Each key member is secured in a selected orientation with respect to its opposing key member so that forward structure or both pass by each other during mating; if another like connector is used in place of one of them, with its key member oriented differently, the forward structure of the opposing key members will abut and prevent further axially forward movement and thereby prevent mating. Orientation of a key member in a connector can be accomplished by using a member of regular polygonal cross-section secured in a passageway of like cross-section, with the number of sides of the polygon determining the number of orientations available from which to select. Using a pair of key members increases the number of keying arrangements to equal the square of the number of sides of the polygon.

It is desired to retain a pair of key members at ends of elongate narrow module housings without additional fastening members.

It is further desirable to retain a key member in a housing in a manner facilitating removal thereof.

It is further desirable to retain a key member in a housing passageway in a manner not permitting rotational movement, nor axial movement or axial misalignment.

It is also desirable to provide retention means for an insert in a housing passageway including a projection moldable along one side of the passageway which can retain the insert in any angular orientation in the passageway against rotational movement, axial movement and axial misalignment.

SUMMARY OF THE INVENTION

The present invention comprises a key member for an electrical connector which is adapted to be inserted into a correspondingly adapted connector passageway to be self-retaining therein without fasteners and which is removable therefrom as desired. The passageway includes a retention section having preferably an annular rib therearound, or a semiannular rib, which seats in a corresponding annular recess of the retention section of the key member. The retention section of the key member is comprised of a plurality of radially inwardly deflectable members which permit the retention section to ride over the annular or semiannular rib of the passageway until full insertion whereupon the deflectable members resile and the rib seats in the annular recess, securing the key member against axial movement or misalignment. The key member has a body section and a keying section forwardly of the retention section which have an outer surface comprising planar surface segments polygonal and preferably hexagonal in cross-section which just fit within a corresponding passageway portion of corresponding cross-section to secure the key member against rotation upon insertion.

According to one embodiment of the present invention where the passageway extends to the rear face of the connector housing the rib is annular and has a rearwardly facing stop surface which stoppingly engages a forwardly facing stop surface defining one side of a first annular recess of the key member. A tool is insertable from the rear housing face to inwardly deflect the deflectable members to remove the key member when desired.

According to another embodiment where it is desired not to continue the passageway to the rear face, the rib is semiannular and is molded by side action molding. In this embodiment the semiannular rib is rounded to seat within a second rounded annular recess of the key member retention section upon full insertion, again deflecting the deflectable members during insertion. In this embodiment a transverse slot in the housing intersects the passageway at the location of the first annular recess; a transverse plate-like section of an article such as a latch member is insertable into the slot from a side of the housing and a pair of fingers of the plate-like section pass both sides of the key member in the first annular recess which preferably again deflects inwardly the deflectable members until a constriction defined between the fingers passes by the key member and the deflectable members resile. At this point the key member is further secured in the passageway against axial movement by the latch member, and additionally the key member acts to provide the means for securing the latch member to the connector in a manner which permits disengagement for removal of either member.

It is one objective of the present invention to provide a key member securable in a connector housing without fasteners in a manner which permits removal.

It is another objective to provide a key member securable in both a plug connector and a receptacle connector.

It is yet another objective to provide a key member which provides a means to secure a latch member to a connector without additional fasteners and in a manner which permits disengagement and disassembly.

DETAILED DESCRIPTION OF THE PREFERRED EMBODIMENT

Figure 1:
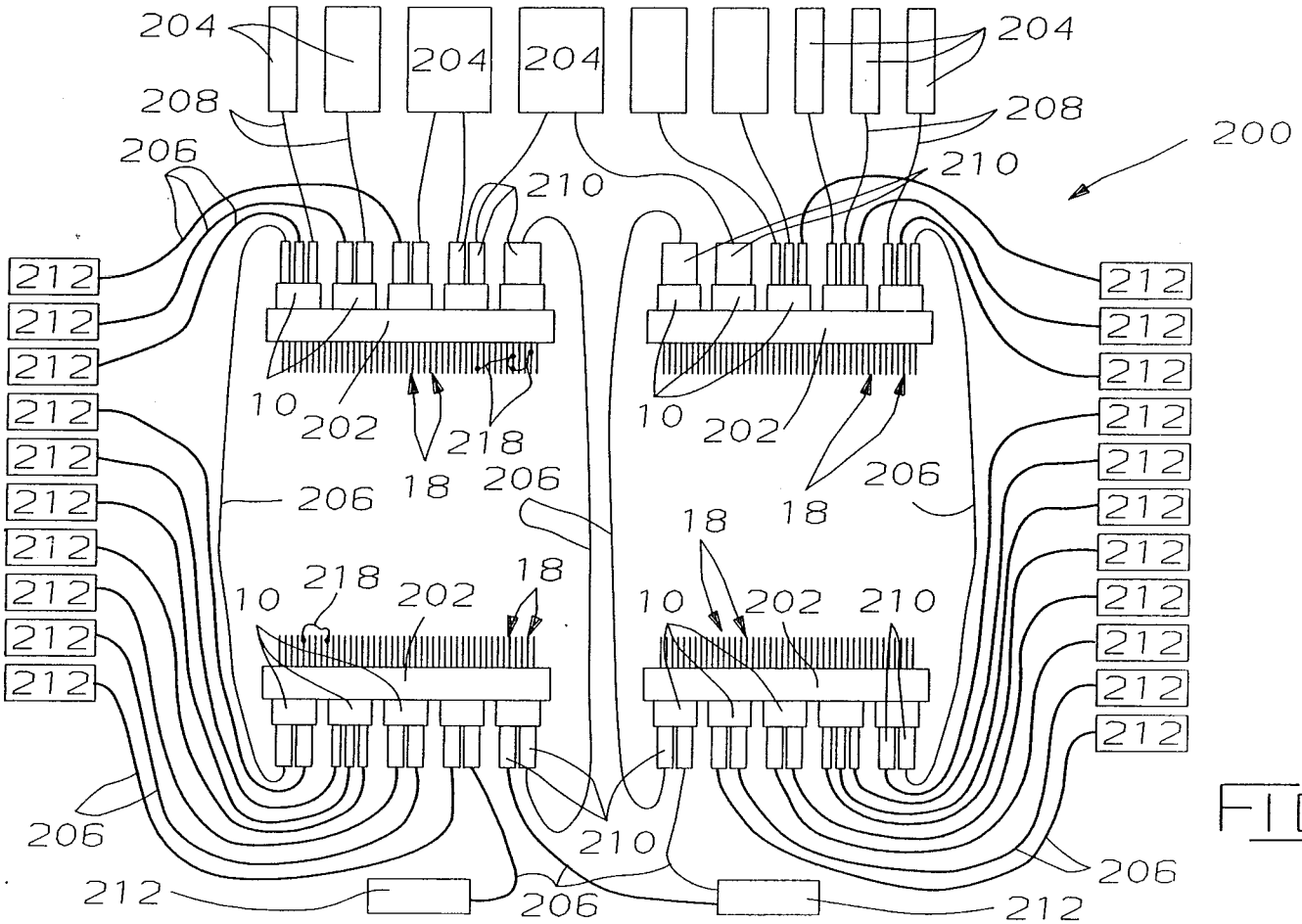
FIGS. 1 and 2 are schematic and perspective views of a wire integration system with which the present invention may be used.
Figure 2:
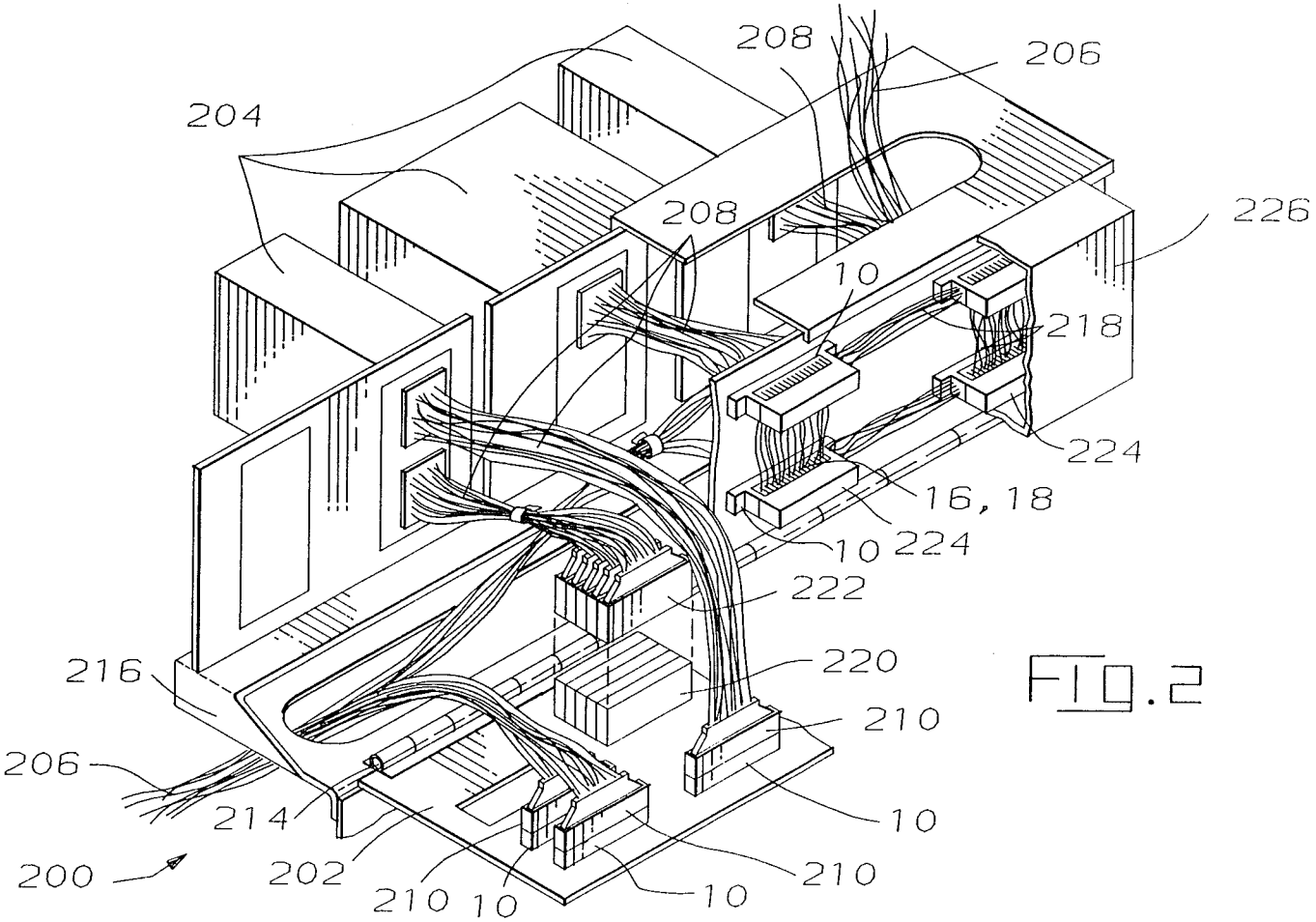

FIGS. 1 and 2 illustrate a wire integration system 200 such as for use on aircraft where a plurality of shipboard systems including power, control, detection, indication, radio reception and transmission and so on must be interconnected or "integrated" at one or more wire integration panels 202 with other such systems. Such systems must be capable of being controlled or sensed at a central location or electrical/electronics bay by a plurality of "black boxes" 204 and also be capable of being interconnected with each other as desired. The black boxes must be capable of removal from the aircraft such as for frequent routine testing and maintenance, or for replacement. Cables 206,208 generally are arranged in bundles or harnesses terminated at one end by modular plug connectors 210 which extend to a wire integration panel 202 on which are mounted receptacle connectors 10 matable at one face of the panel with plug connectors 210.

Along the face of the panel opposed from the face receiving plug connectors 210, in the embodiment shown, terminals 16 of receptacle connectors 10 are secured in housings 12 and have wire wrap posts 18 extending outwardly therefrom for one or more electrical conductor wires 218 to be wrapped for electrical connection to corresponding one or more terminals of respective one or more electrical systems as desired. Preferably post protectors 224 are secured over the wire wrap arrays, and a cover plate 226 is mounted to the panel for additional protection.

The other ends of cables 206 are electrically connected with shipboard systems 212 or another wire integration panel 202, while the other ends of cables 208 are electrically connected to black boxes 204. The mating plug and receptacle connector assemblies 210,10 must be modular and panel mountable; be uniquely keyed; be easily latchable upon mating in an aligned, keyed and polarized manner; and be easily delatchable. Integration panel 202 can have receptacle connectors 10 mounted thereto and automatically or semi-automatically wired as a total subassembly and tested prior to installation into the aircraft, and also can be removed from the aircraft for testing, repair or replacement if necessary. Panel 202 is hinged at hinge 214 to be lowered forwardly from a supporting structure 216 for easy access to the rearward face of the panel. This access facilitates programming and reprogramming which is essential in order to adapt an aircraft of otherwise standard manufacture to meet the avionic requirements of specific customer airlines.

Figure 3:
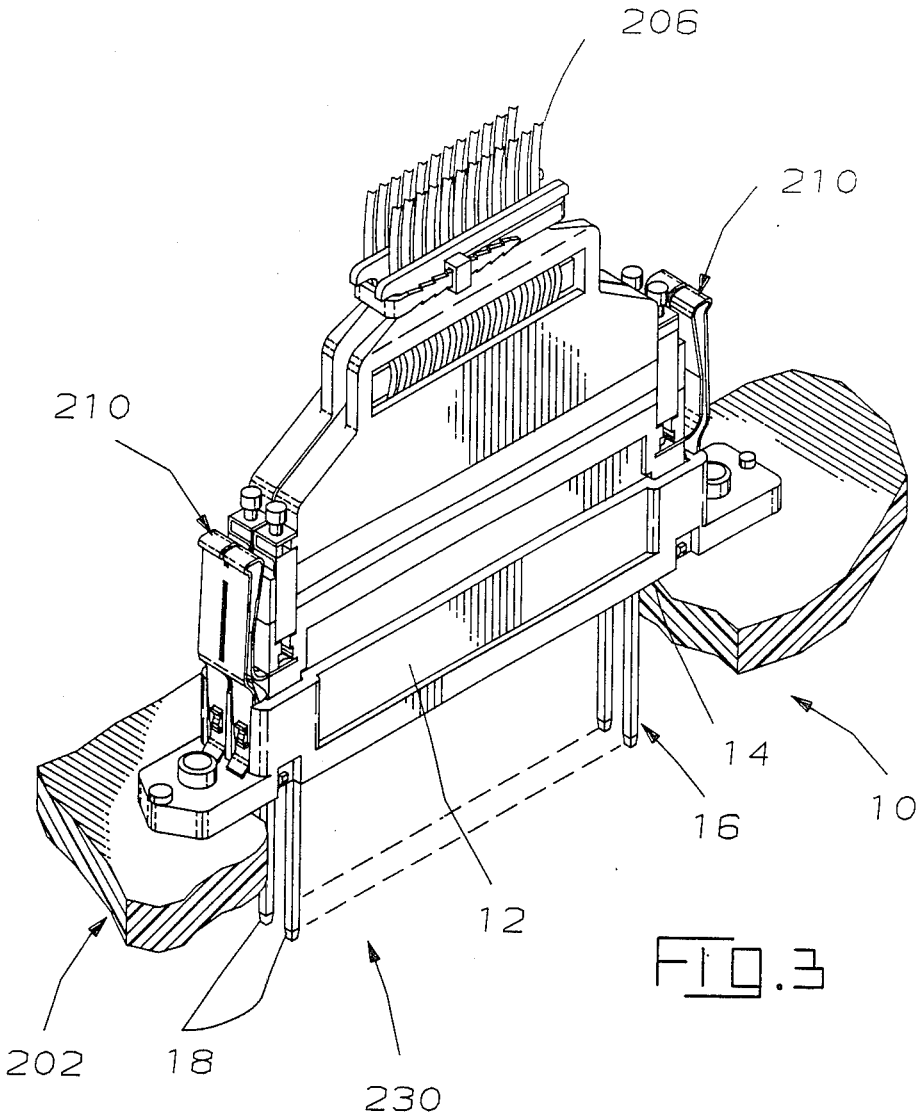
FIG. 3 is a perspective view of mated plug and receptacle connectors for use on a wire integration panel of the system of FIGS. 1 and 2.

FIG. 3 shows a two-row plug connector 210 mated with a two-row receptacle connector 10 mounted to integration panel 202 of FIG. 2, with an array of wire wrap posts 18 of terminals 16 extending from a wire wrap face 14 of the receptacle connector 10. Such a mating connector system 230 for the wire integration system 200 of FIGS. 1 and 2 is described with more particularity in U.S. patent application Ser. Nos. 07/042,205; 07/042,201, U.S. Pat. No. 4,735,583; Ser. Nos. 07/042,203; 07/042,084, U.S. Pat. No. 4,726,791; and Ser. No. 07/042,418, U.S. Pat. No. 4,752,248; all filed Apr. 24, 1987 and all assigned to the assignee hereof.

Figure 4:
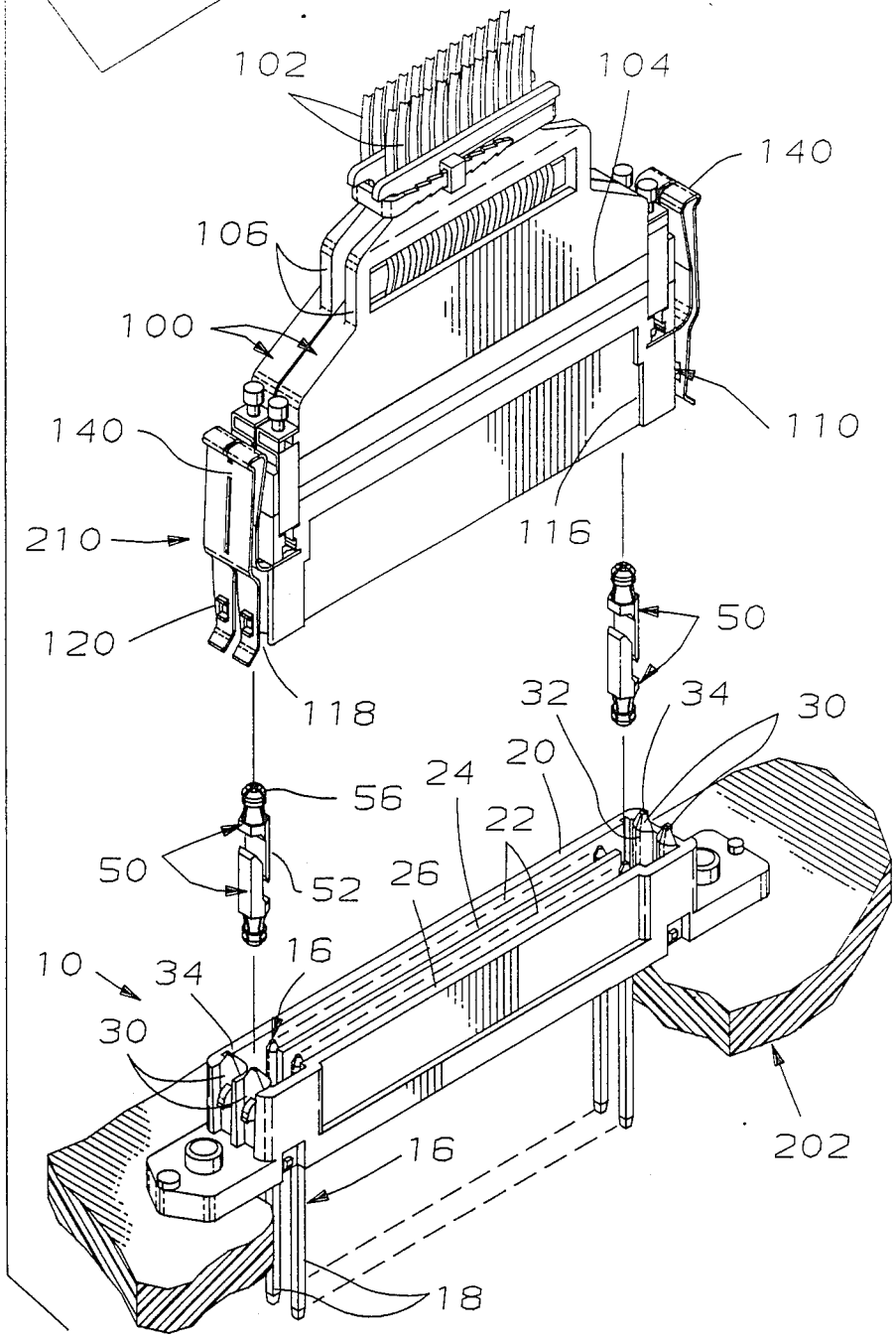
FIG. 4 is a perspective view of a receptacle connector and a plurality of ganged plug connector modules to be mated thereto, with key members of the present invention exploded therefrom.
Figure 6:
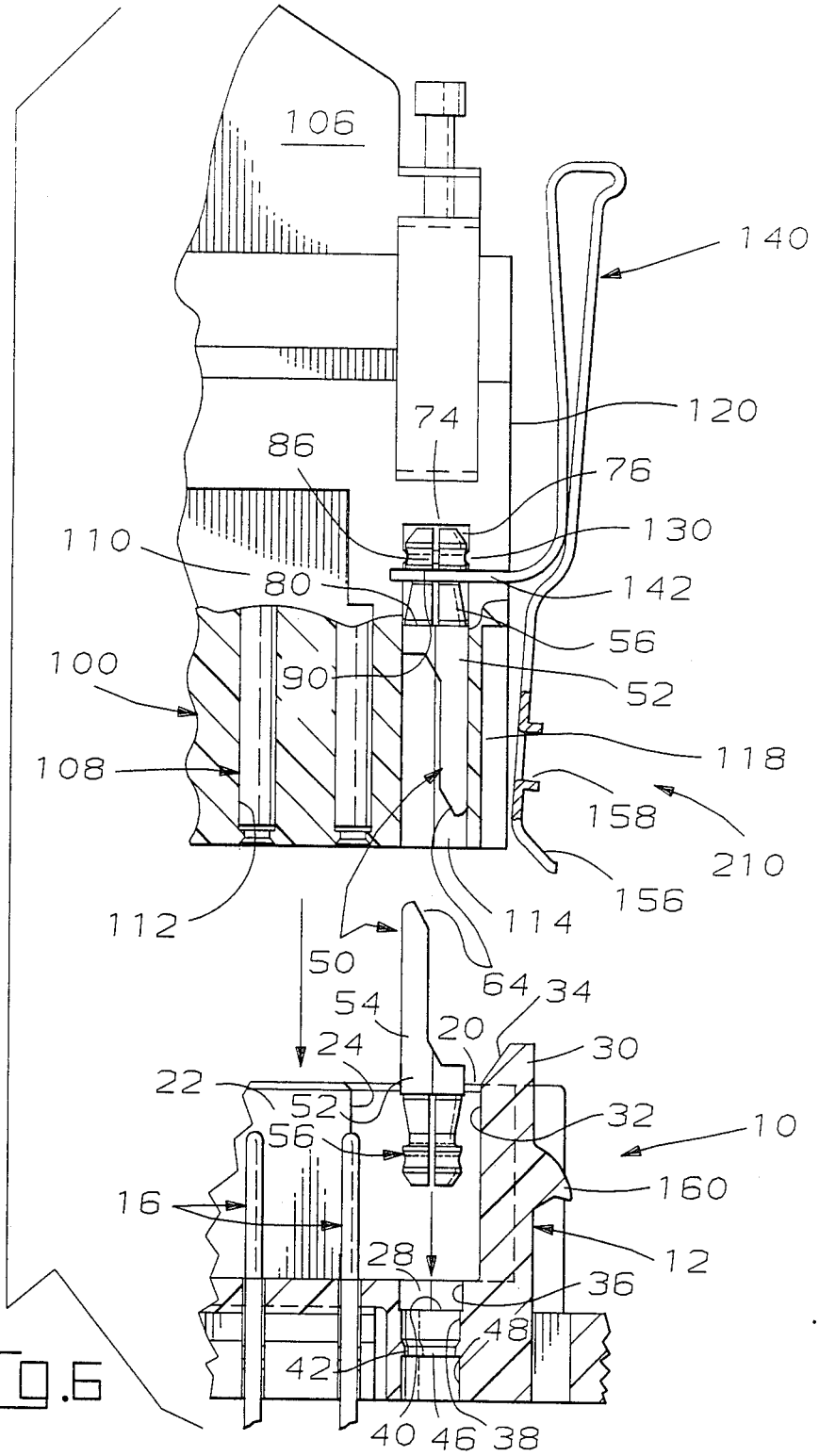
FIG. 6 is a part section view of one plug module spaced from the receptacle connector, with a spring latch member secured to the key member in the plug module, and a key member exploded from the receptacle connector for insertion into its passageway.

In FIG. 4, two-row plug connector 210 is shown comprising two single-row plug connector modules 100 ganged together in side-by-side relationship matable with two-row receptacle connector 10. Each module 100 receives an array of electrical conductor cables 102 in a cable face 104, with each array of cables firmly engaged by a strain relief 106 of each module 100. Terminals 108 terminated to conductors 102 are secured within module housings 110 within terminal-receiving passageways 112 (FIG. 6). Each module housing 110 includes a key-receiving passageway 114 at each end of the row of terminal-receiving passageways 112, to receive and secure thereinto a key member 50. Modules 100 are ganged together by a pair of integral spring latch members 140 more particularly described in above-mentioned application Ser. No. 07/042,201.

Receptacle connector 10 comprises a receptacle housing 12 generally having a peripheral hood 20 defining a receptacle section to receive a forward section of plug connector 210 thereinto during mating. The receptacle section is comprised of plug-receiving cavities 22 associated with forward sections of respective modules 100, which cavities 22 are separated from each other by a length of the polarizing barrier wall 24. Barrier wall 24 serves to permit only the proper orientation of a respective module 100 by entering a corresponding long recess 116 along just one of the two major sides of the module. One of the two major sides of receptacle connector 10 has an indentation 26 appropriately configured to act as a polarizing barrier wall for the end module, as is more particularly described in above mentioned application Ser. No. 07/042,084. Near both ends of each cavity 22 are key-receiving passageways 28 within which are secured key members 50. At both ends of each cavity 22 are disposed alignment posts 30 having semicylindrical inwardly facing surfaces 32 and a tapered forward post end 34. An alignment post 30 enters a corresponding alignment channel 118 along end surface 120 of module 100 during initial stages of mating of the connectors, which aligns modules 100 both spatially and axially before opposing key members 50 of both connectors engage, only after which contacts 108,16 engage.

Figure 5:
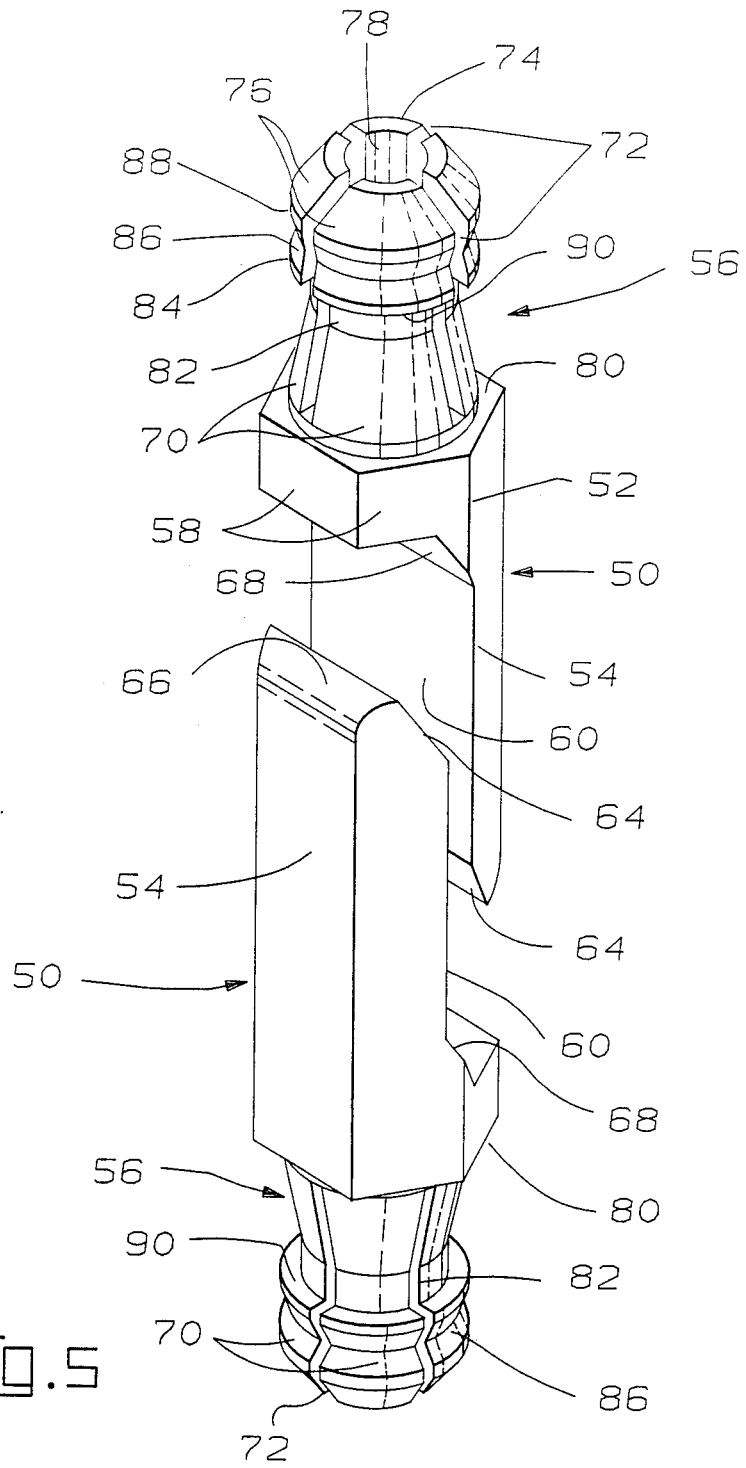
FIG. 5 is a perspective view of two key members of the present invention in keyed orientation.

As shown in FIG. 5, each key member 50 comprises body section 52, keying section 54 forwardly thereof, and retention section 56 rearwardly thereof, and is preferably machined of high temper aluminum. Body section 52 has an outer surface comprised of axially extending planar surface segments 58 so angled with respect to each other that body section 52 in cross-section has the shape of a regular polygon, such as preferably a hexagon. Keying section 54 extends forwardly from body section 52 on only one side of a plane intersecting the axis of key member 50. Inner surface 60 thereof is planar and is spaced a slight distance from the medial plane (not shown) which preferably intersects opposing corners of the hexagon. The outer surface preferably comprises planar surface segments 62 extending continuously axially forwardly from surface segments 58 of body section 52; thus, the cross-section of keying section 54 is generally shaped like just less than one half of the polygon which is preferably a hexagon. An outwardly tapered surface 64 concludes the forward end of inner surface 60 which comprises a lead-in for receiving an opposing key member 50 therealong during the initial stages of mating of connectors 10,210; forward end 66 of keying section 54 also is rounded, preferably, at the ends of outer surface segments 62. Another tapered surface 68 concludes the rearward end of inner surface 60 where keying section 54 joins body section 52 in order to strengthen the joint.

Retention section 56 preferably comprises four quadrants 70 each of which extends axially rearwardly from body section 52. Gaps 72 divide quadrants 70 from each other, and have a width selected to allow limited radially inward deflection of quadrants 70 during insertion into a respective key-receiving passageway 28,114 of connectors 10,210 during assembly thereof. At rearward end 74, the outer periphery 76 of each quadrant 70 is chamfered to comprise a lead-in to facilitate insertion into a respective passageway 28,114. A bore 78 preferably extends into retention section 56 from rearward end 74 to remove material and facilitate radially inward deflectability of quadrants 70. Retention section 56 is preferably cylindrical in cross-section at any location and has a greater diameter not greater than and preferably less than, the least cross-sectional dimension of body section 52 such that a rearwardly facing stop surface 80 is defined between body section 52 and retention section 56. Rearwardly from stop surface 80 retention section 56 is gradually tapered to facilitate deflection, to a first reduced diameter annular retention recess 82 and then a first full-diameter collar 84 defining a substantially forwardly facing stop surface 90. Rearwardly of collar 84 is second annular retention recess 86, which is preferably rounded, followed by a second full-diameter collar 88.

Figure 7:
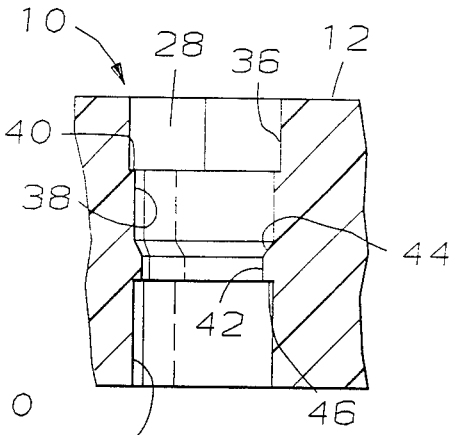
FIGS. 7 and 8 are part section views of the passageways of the receptacle connector and plug connector module respectively.

As shown in FIGS. 6 and 7, key-receiving passageway 28 of receptacle connector 10 is adapted to receive key member retention section 56 and key member body section 52 thereinto to be secured and retained therein. First portion 36 is associated with body section 52 and has a cross-sectional shape identical to that of body section 52 which is a regular polygon and preferably a hexagon, and is dimensioned to be just slightly larger than body section 52 to receive body section 52 therewithin in a selected angular keying orientation and which prevents body section 52 from rotational movement. Second portion 38 is round with a diameter just larger than the largest diameter of retention section 56, and a forwardly facing stop surface 40 is defined between first and second passageway portions 36,38 associated with stop surface 80 of key member 50. Spaced rearwardly from stop surface 40 is annular retention rib 42 which is preferably associated with first annular recess 82 of retention section 56, and has a gradually tapered forward surface portion 44 and a rearwardly facing stop surface 46. Tapered surface 44 will initiate radially inward deflection of quadrants 70 of key member 50 during insertion when quadrant beveled end surfaces 76 engage tapered surface 44. Inwardly deflected quadrants 70 will enable second collar 88 to ride over rib 42 and also first collar 84, and rib 42 will seat within first annular recess 82. The normal disposition of stop surface 46 against forwardly facing stop surface portion 90 of first collar 84 will prevent inadvertent axially forward movement of key member 50 once fully inserted into passageway 28. However, third passageway portion 48 exposed to the rear face of receptacle connector 10 will permit entry of a tool (not shown) to deflect inwardly quadrants 70 to permit passage over rib 42 for desired removal of key member 50.

Figure 8:
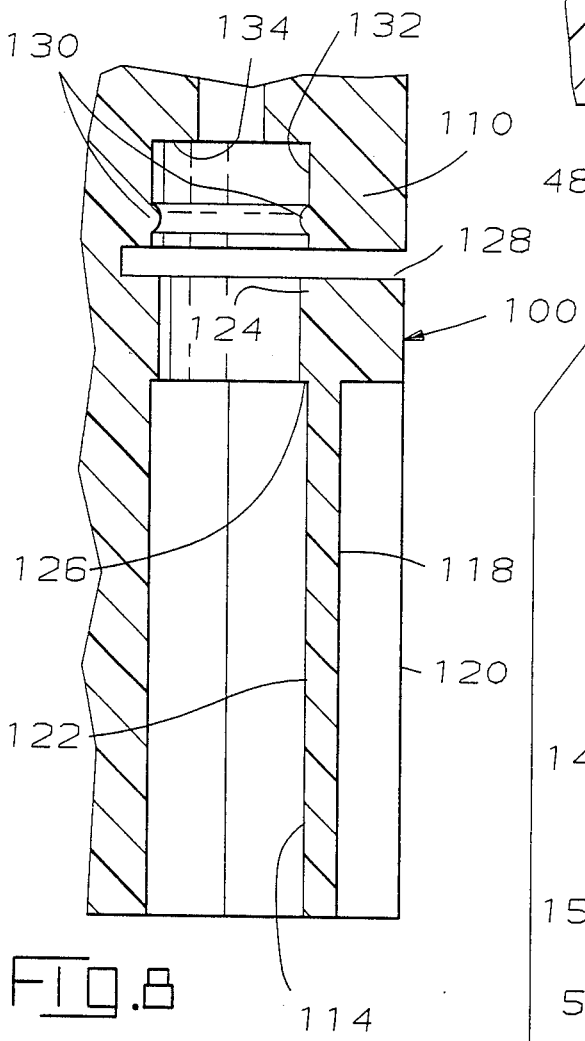

Referring to FIGS. 6 and 8, key-receiving passageway 114 of plug connector module 100 is adapted to receive a key member 50 entirely therewithin in a selected angular keying orientation. Elongate forward or first section 122 is associated with body section 52 and keying section 54 and has a cross-sectional shape identical to that of body section 52 which is preferably hexagonal, and is dimensioned to be just slightly larger therefrom to receive body section 52 therewithin and prevent rotational movement thereof after insertion. Second portion 124 is round with a diameter just larger than the largest diameter of retention section 56, and a forwardly facing stop surface 126 is defined between portions 122 and 124 and is associated with stop surface 80 of key member 50. Transverse slot 128 extends inwardly from end surface 120 and intersects passageway second portion 124 at that axial location associated with first annular recess 82 of key member 50, for receipt of securing section 142 of spring latch 140 after key member 50 has been fully inserted into passageway 114 and when the various modules 100 are desired to be ganged together to assemble plug connector 210 as shown in FIG. 4. Rearwardly from slot 128 is rounded retention rib 130 which is associated with second annular retention recess 86 of key member 50, and which is preferably rounded. Rear portion 132 of passageway 114 receives ends of quadrants 70 including second collar 88. Rounded rib 130 seats within second annular recess 86 to adequately hold key member 50 against inadvertent axial and lateral movement at least during shipping and handling by tightly fitting in recess 86, and is preferably supplemented prior to mating and for in-service use by mutually securing engagement with spring latch member 140, as is shown in FIGS. 8 and 9.

In the preferred embodiment of plug module 100 it is preferred to use the structure of housing 110 rearwardly of passageway 114 and key member 50 for another purpose, which is to secure a cable strain relief assembly to housing 110 as is described in greater particularity in above-mentioned application Ser. No. 07/042,203. To this end, the rearward end of passageway 114 is practically closed off at 134 which during molding prevents retention rib 130 from being molded using a core pin from rearwardly of the mold cavity in a conventional two-draw molding process. Therefore, retention rib 130 may be molded using a side action draw mold (not shown) where a core pin extends into the mold cavity from relatively the near side of module housing 110 and when withdrawn leaves an opening 136 extending into housing 110 and merging into second portion 124 of passageway 114 from a major side of module housing 110. As a result, rearwardly of stop surface 126, passageway 114 is open toward the major side and is therefore semicylindrical in shape, and consequently retention rib 130 extends around half of the circumference of passageway 114. However, this semiannular rib 130 is sufficient to seat in second annular recess 86 for securing of key member 50. Similarly to securing key member 50 into passageway 28 of receptacle connector 10, securing a key member 50 into passageway 114 involves deflection of quadrants 70 radially inwardly as they pass over semiannular rib 130 prior to seating. Deflection is facilitated because body section 52 and keying section 54 are disposed in a close fit along most of first passageway portion 122 at this time, which maintains axial alignment under the lateral stress by semiannular rib 130.

Figure 9:
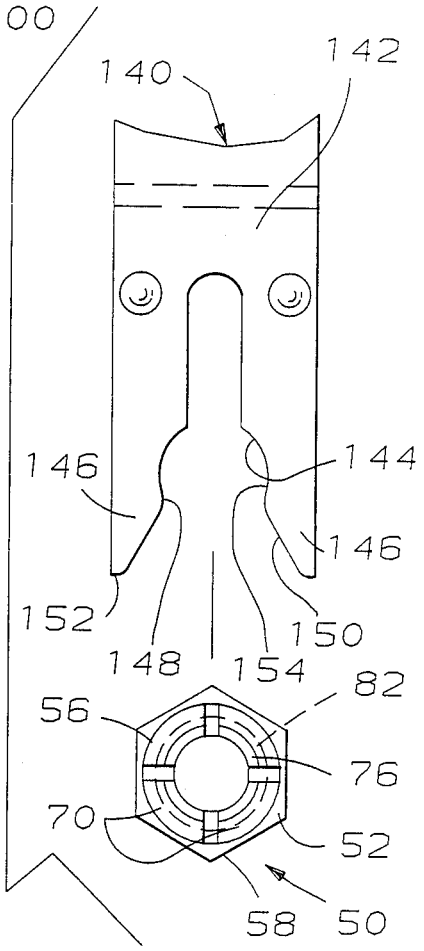
FIG. 9 is a plan view showing a latch member securing section securable to a key member.

Referring to FIGS. 6 and 9, spring latch member 140 secures to key member 50 of plug module 100 by securing section 142 extending into transverse slot 128 from end surface 120 of module 100. Securing section 142 is adapted to secure to an axially extending projection such as retention section 56 of key member 50, by receiving the projection into securing recess 144 defined by fingers 146. When spring latch member 140 is urged transversely against end surfaces of modules 100 and securing section 142 enters transverse slot 128, fingers 146 extend past both sides of retention section 56 in first annular recess 82 so thay key member 50 enters securing recess 142. Facing surfaces of fingers 146 define a constriction 148 which causes quadrants 70 to be radially inwardly deflected as constriction 148 passes by and an enlarged recess area therebehind allows quadrants 70 to resile. With fingers 146 around most of first annular recess 82, stop surface 90 of first collar 84 now stops forward axial movement of key member 50 by engaging securing section 142 of spring latch member 140, which is itself secured against forward axial movement by transverse slot 128. Constriction 148 preferably is comprised of first facing surfaces 150 whcih are angled slightly outwardly toward ends 152 of fingers 146 defining a lead-in, and second facing surfaces 154 which are angled slightly toward spring latch member 140 defining a lead-out enabling removal of securing section 142 from key member 50 when spring latch member 140 is urged away from module 100 for removal.

Key member 50 thus provides a means for securing spring latch member 140 to module 100 without the assembly requiring additional fasteners therefor, and in a manner which permits spring latch member 140 to be disassembled from the module. Spring latch member 140, in return, provides a supplemental retention mechanism holding key member 50 is passageway 114, assisting semiannular rib 130. This supplemental retention which could, if desired, be relied upon as the only means of retention, supplanting semiannular rib 130, permits using the module housing structure rearward of passageway 114 for other purposes at odds with the existence of a passageway section having the diameter of second passageway portion 124 resulting from a molding process having a rear action core pin.

Figure 10:
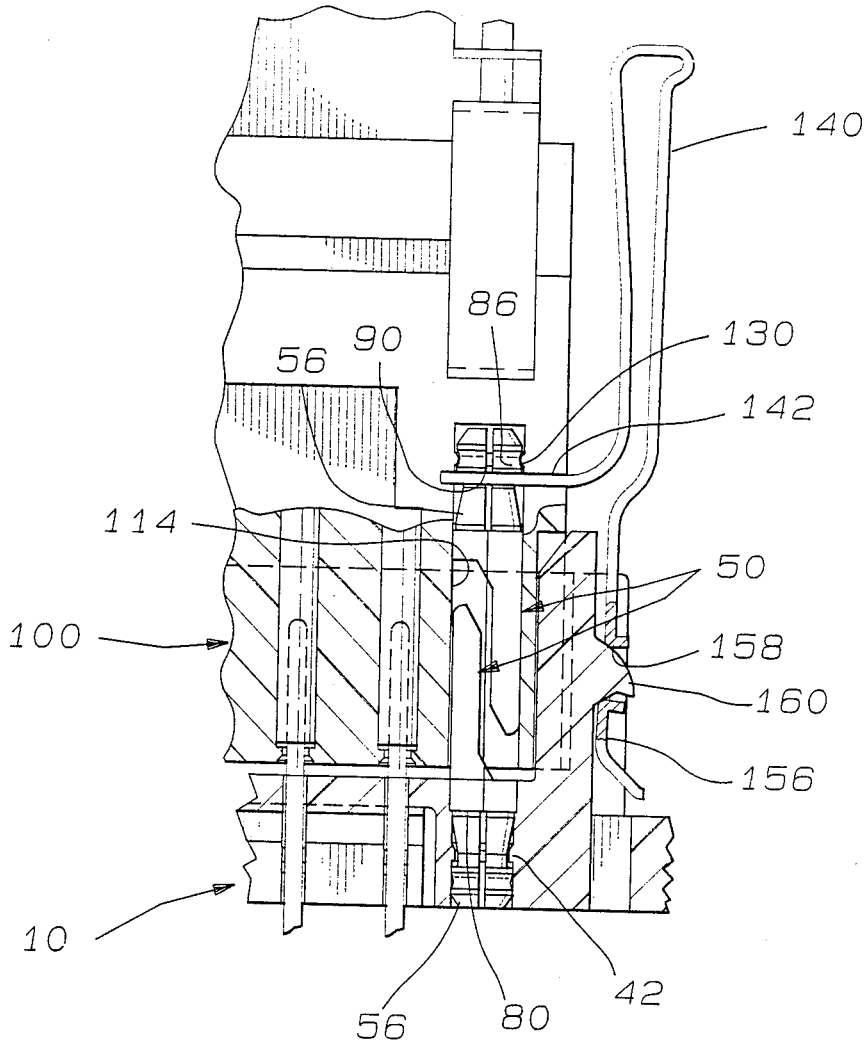
FIG. 10 shows the plug module and receptacle connector of FIG. 6 in keyed, mated and latched relationship.

FIG. 10 shows spring latch member 140 secured to module 100 and having a forward free end 156 with a latching recess 158 latched to a latching projection 160 of receptacle connector 10, latching module 100 and receptacle connector 10 in mated condition, respective keys 50 being in cooperable keyed orientation with respect to each other.

In the present invention, an electrical connector key member is insertable into an appropriately shaped housing passageway to be retained securely therein without fastener parts and in a manner permitting removal thereof if desired. The retention mechanisms prevent axial movement and misalignment, and also prevents rotation especially if the hexagonal shape is used, since polygonal shapes with more than six sides begin to approximate a cylindrical shape and tend to permit undesired rotation considering manufacturing tolerances and dimensional differences between the key member outer surface and the passageway inside surface. The embodiment shown permits use of identical key members in both a plug connector and a receptacle connector, and with two different ways to secure the same key member in a housing.

The provision of radially inwardly deflectable structure comprising the retention section of the key member of the present invention can possibly be met by deflectable members having a different shape, or being different in number, than the four quadrants shown, and be within the spirit of the invention and the scope of the claims. The rounded nature of semiannular rib 130 and the corresponding shape of second annular recess 86 is preferred to enable withdrawal of key member 50 from passageway 114 of plug module 100 once spring latch member 140 has been disengaged, but elimination thereof in reliance on the spring latch member for retention, or use of a different shape is within the spirit of the invention. Other modifications may be made to the preferred embodiments shown and described herein, which are also within the spirit of the invention and the scope of the claims.

What is claimed is:

1. A key member for an electrical connector cooperable with another opposing key member of a mating connector upon mating of said connector with said mating connector, comprising:

an article having a body section, a keying section extending forwardly from said body section, and a retention section extending rearwardly from said body section, said body section having planar axially extending outer surface segments and having a cross-section comprising the shape of a selected regular polygon;

said keying section being disposed entirely along one side of a plane intersecting a longitudinal axis of said article with an inwardly facing surface spaced an incremental distance from said plane, and an outer surface comprised of planar segments extending axially forwardly from ones of said outer surface segments of said body section disposed on said side of said plane, said keying section in cross-section generally comprising the shape of one-half of said polygon;

said retention section being dimensioned smaller than said body section and comprising a plurality of segments extending rearwardly from said body section, each said segment being spaced from adjacent ones of said segments and adapted to be deflectable radially inwardly, said retention section including at least a first annular retention recess around said plurality of segments and having at least a tapered rearward side wall, whereby upon insertion of said article into a key-receiving passageway having a corresponding polygonal-shaped forward section and a smaller dimensioned rearward section, said polygonal-shaped body section closely fits within a rear portion of said polygonal-shaped forward passageway section securing said article in a selected orientation against rotation, and a retention rib means extending circumferentially around at least portions of said rearward passageway section deflects said plurality of segments radially inwardly during insertion and is receivable in a tight fit into said first annular retention recess after said deflected segments resile upon full insertion securing said article against axial and lateral movement in said passageway, and said retention rib means engages said tapered rearward recess side wall and deflects said plurality of segments enabling removal of said article from said passageway upon the application of sufficient axially forward force to said article, all whereby the retention section may be removably disposed entirely within the rearward passageway section of the connector securing the key member in the connector without other fasteners, and the rearward passageway section need not extend to the rearward end of the connector for key member retention to be provided.

2. A key member as set forth in claim 1 wherein said body section includes a rearwardly facing stop shoulder stoppingly engageable with a forwardly facing stop means of said passageway upon full insertion.

3. A key member as set forth in claim 1 wherein said keying section includes a forward end having an inwardly and forwardly facing tapered surface portion comprising a lead-in to facilitate initial receipt of a keying section of a corresponding key member in proper keyed orientation along said inwardly facing surface during mating of said connector and a mating connector.

4. A key member as set forth in claim 1 wherein said retention section includes a second annular retention recess, whereby said retention section provides a means for securing to said connector a transverse plate-like section of another article inserted transversely into a slot of said connector housing intersecting said passageway at said second annular retention recess, said plate-like section having a pair of securing fingers extending around and past two opposing sides of said retention section within said retention recess in bearing engagement therewith and deflected thereby, said securing fingers defining a constriction at forward ends thereof extending partially around a far side of said retention section to secure said another article to said article and thereby to said connector.

5. A key member as set forth in claim 1 wherein said retention section comprises four quadrants.

6. A key member as set forth in claim 5 wherein said retention section includes a rearward end having a beveled peripheral surface comprising a lead-in to facilitate initial insertion into said passageway and to initiate deflection of said quadrants upon engagement with said retention rib means.

7. A key member as set forth in claim 1 wherein said selected regular polygon is a hexagon.

8. A key member as set forth in claim 7 wherein said plane intersects opposing corners of said hexagon.

9. An electrical connector assembly of a plug connector having a selected keyed relationship and comprising a plug connector having housing means and a plurality of first terminals secured thereto having first contact sections proximate a mating face thereof; a receptacle connector having housing means and a plurality of second terminals secured thereto having second contact sections proximate a mating face thereof, said receptacle connector adapted to be axially mated with said plug connector along their said mating faces, and said first and second contact sections adapted to electrically engage each other upon full mating of said plug connector and said receptacle connector; said plug and receptacle connectors each having at least one key-receiving passageway extending rearwardly from respective said mating faces for receiving thereinto a respective key member thereinto in a fixed selected keying orientation to be secured thereto; and at least one associated pair of key members each to be disposed in a respective said key-receiving passageway and having a body section and a keying section extending forwardly therefrom and disposed entirely along one side of a plane intersecting a longitudinal axis of said key member with an inwardly facing surface spaced an incremental distance from said plane, to cooperate with a keying section of an opposing said keying member during mating of said plug and receptacle connectors for keying thereof; said assembly being characterized in that:

said body section of each said key member has an outer surface comprised of planar axially extending segments and has a cross-section comprising the shape of a selected regular polygon;

each said key member includes a retention section rearwardly from said body section having a dimension smaller than said body section and comprising a plurality of segments extending rearwardly from said body section, each said segment being spaced from adjacent ones of said segments and adapted to be deflectable radially inwardly, said retention section including at least one annular retention recess around said plurality of segments;

each said key-receiving passageway including at least a retention section having first and second portions to receive and secure therein said key member body section and said key member retention section respectively, said first portion of said passageway retention section having a cross-sectional shape identical to that of said key member body section and dimensioned to be just larger than a said body section of a said key member to secure said body section against rotational movement when said key member is fully inserted and secured in said passageway;

said second portion of said passageway retention section having a dimension smaller than that of said first portion and just larger than that of said key member retention section and further having retention rib means extending circumferentially around at least portions thereof and radially inward a selected distance to deflect said plurality of segments radially inwardly during insertion and fit tightly into said at least one annular retention recess of said key member after said deflected segments resile upon full insertion of said key member into said passageway to secure said key member against axial and lateral movement therewithin, whereby the retention section is disposed entirely within the second passageway portion of the connector securing the key member in the connector without other fasteners, and the second passageway portion need not extend to the rearward end of the connector for key member retention to be provided.

10. An electrical connector assembly as set forth in claim 9 further characterized in that each key-receiving passageway of one of said plug connector and said receptacle connector further includes a forward section forwardly of said retention passageway section along which extends a said keying section of a respective said key member secured in said passageway and into which is received a keying section of an opposing key member secured in a proper keying orientation in an opposing said passageway of the other of said plug connector and said receptacle connector with said opposing key member keying section extending forwardly of said mating face thereof, for keying cooperation with said key member to key said plug and receptacle connectors during mating.

11. An electrical connector assembly as set forth in claim 9 further characterized in that the outer surface of said keying section of a said key member is comprised of planar segments extending continuously axially forwardly from said planar outer surface segments of said body section, and said keying section in cross-section generally comprising the shape of just less than one half of said selected regular polygon.

12. An electrical connector assembly as set forth in claim 9 further characterized in that said at least one annular retention recess includes at least a rearward tapered side wall to facilitate deflection of said segments by said retention rib means after said key member has been inserted into said connector, whereby the key member is removable from the connector solely upon the application of sufficient axially applied force from forwardly thereof.

13. An electrical connector assembly as set forth in claim 9 further characterized in that at least one of said key members includes a second annular recess having a transverse forwardly facing side wall, and said retention rib means of a corresponding one of said plug and receptacle connectors includes a transverse rearwardly facing shoulder cooperating with said forwardly facing recess side wall to stop forward movement of said at least one of said key members after full insertion into said corresponding connector, and said second passageway portion of said corresponding connector communicates with a rearward face thereof enabling insertion of tool means to deflect said segments radially inwardly, whereafter said at least one of said key members is removable from said corresponding connector.

14. An electrical connector assembly as set forth in claim 9 further characterized in that said key members are identical and at least said first portions of said retention sections of said key-receiving passageways are identical.

15. An electrical connector assembly as set forth in claim 14 further characterized in that said retention section of each said key member includes a second annular recess, and said plug connector housing means includes a transverse slot extending inwardly from an end surface thereof and intersecting said second portion of said retention section of each said key-receiving passageway thereof at the location of one of said at least one annular recess and said second annular recess, enabling receipt of a transverse plate-like securing section of an article inserted thereinto from said end surface to secure to said key member retention section thereat, whereby an article is securable to said plug connector after said key member is secured in said key-receiving passageway.

16. An electrical connector assembly as set forth in claim 14 further characterized in that said retention section of each said key member comprises four quadrants.

17. An electrical connector assembly as set forth in claim 16 further characterized in that said retention rib means extend around one half of said second portion of said passageway retention section, enabling molding of retention rib means in a side action core pin molding process and eliminating necessary access to said passageway retention section from rearwardly thereof by other core pin means of a mold.

18. In combination, a key member and a latch member for an electrical connector which mutually secure each other within and to a housing means of the connector, comprising:

a key member including a retention section rearwardly of a keying section thereof, said retention section including an annular recess;

a latch member including a latching section and further including a securing section extending transversely of a body section thereof, said securing section having a free end comprising a pair of coextending fingers defining a key-receiving recess therebetween and a constriction near ends of said fingers dimensioned to be just smaller than the diameter of said key member retention section at said annular recess;

connector housing means including a key-receiving passageway adapted to receive said key member thereinto, said housing means further including means to receive said latch securing section thereinto from transversely thereof at the location of said key member annular recess after said key member is inserted into said key-receiving passageway; and at least one of said key member retention section at said annular recess and said latch securing section fingers at said constriction being deflectable to permit passage of said fingers past said key member retention section at said annular recess, whereby said latch member is urgeable toward said housing means proximate said key member with said securing section fingers thereof passing around said key member retention section within said annular recess, and after said deflectable at least one of said retention section and said securing section fingers resile said constriction grips around an inner side of said retention section disposed in said recess to secure said latch member to said housing means and said securing section retains said key member in said passageway.

19. The combination of claim 18 wherein said key member retention section comprises radially inwardly deflectable members.

20. The combination of claim 18 wherein said securing section fingers are outwardly deflectable.

* * * * *